US011348539B2

(12) United States Patent
He

(10) Patent No.: US 11,348,539 B2
(45) Date of Patent: May 31, 2022

(54) DRIVING METHOD OF DISPLAY DEVICE AND DISPLAY DEVICE

(71) Applicant: HKC CORPORATION LIMITED, Guangdong (CN)

(72) Inventor: Huailiang He, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 16/313,412

(22) PCT Filed: Jan. 16, 2018

(86) PCT No.: PCT/CN2018/072825
§ 371 (c)(1),
(2) Date: Dec. 26, 2018

(87) PCT Pub. No.: WO2019/119587
PCT Pub. Date: Jun. 27, 2019

(65) Prior Publication Data

US 2021/0183323 A1 Jun. 17, 2021

(30) Foreign Application Priority Data

Dec. 20, 2017 (CN) ..... 201711382370.6

(51) Int. Cl.
*G09G 3/36* (2006.01)
*G09G 3/34* (2006.01)

(52) U.S. Cl.
CPC ..... *G09G 3/3413* (2013.01); *G09G 3/3607* (2013.01); *G09G 2320/0242* (2013.01); *G09G 2320/0666* (2013.01)

(58) Field of Classification Search
CPC ..... G09G 3/3413; G09G 3/3607; G09G 2320/0242; G09G 2320/066;
(Continued)

(56) References Cited

U.S. PATENT DOCUMENTS

2018/0139429 A1* 5/2018 Park ..... G09G 5/10
2018/0146120 A1* 5/2018 Min ..... H04N 1/6061

FOREIGN PATENT DOCUMENTS

CN 105336298 A 2/2016
CN 106128405 A 11/2016
(Continued)

OTHER PUBLICATIONS

International Search Report for PCT/CN2018/072825, dated Sep. 13, 2018.

*Primary Examiner* — Dennis P Joseph

(57) ABSTRACT

A driving method of a display device and the display device, a display panel includes at least one pixel area and at least one backlight module area. The pixel area and the backlight module area are in one-to-one correspondence. Each of the pixel areas includes a plurality of pixel units. The driving method includes: acquiring a first component, a second component, and a third component of each of the pixel units in the pixel area in a first color space; acquiring a tone angle value and a saturation in a second color space according to an average value of the first component, an average value of the second component, and an average value of the third component of the pixel unit in the pixel area; acquiring a maximum target gray-scale value of a specified pixel unit in the pixel area according to the tone angle value and the saturation; matching a display gray-scale value group corresponding to the specified pixel unit to a target gray-scale value group according to the maximum target gray-scale value; the number of gray-scale values in the display gray-scale value group is equal to the number of gray-scale values in the target gray-scale value group, the maximum target gray-scale value is less than a maximum display gray-scale value in the display gray-scale value group; and driving the
(Continued)

specified pixel unit in the pixel area to display according to the target gray-scale value group.

11 Claims, 7 Drawing Sheets

(58) Field of Classification Search
CPC ..... G09G 2320/062; G09G 2320/028; G09G 2320/068
See application file for complete search history.

(56) References Cited

FOREIGN PATENT DOCUMENTS

| | | | |
|---|---|---|---|
| CN | 106782307 | A | 5/2017 |
| CN | 106782375 | A | 5/2017 |
| CN | 107863085 | A | 3/2018 |

* cited by examiner

DRIVING METHOD OF DISPLAY DEVICE AND DISPLAY DEVICE

CROSS REFERENCE TO RELATED APPLICATIONS

This is a National Stage application of, and claims priority to, PCT/CN2018/072825, filed Jan. 16, 2018, which claims priority to CN Patent Application No. 201711382370.6, filed Dec. 20, 2017, the disclosures of which are incorporated herein by reference in their entirety.

TECHNICAL FIELD

Embodiments of the present disclosure relate to the field of display technologies, and more particularly relate to a driving method of a display device and the display device.

BACKGROUND

With the increasing application of liquid crystal display devices, the color shift phenomenon of the liquid crystal display device under a large viewing angle has become an urgent problem to be solved in the development of liquid crystal display panels.

The liquid crystal display device generally includes a plurality of pixel units, each of the pixel units corresponds to a driving voltage according to a requirement of a display gray-scale value. Under the large viewing angle, different driving voltages cause different degrees of change in phase delay of light having different wavelengths, and the influence on the transmittance of light is also different, such that the user feels a significant decrease in color vividness when viewing a red image.

SUMMARY

Accordingly, embodiments of the present disclosure provide a driving method of a display device and the display device, which can solve the problem of the influence of high gray-scale on the color saturation of a specified pixel unit under a large viewing angle, thereby optimizing the display effect of the display device.

The embodiments of the present disclosure provide a driving method of a display device. The display panel includes at least one pixel area and at least one backlight module area. The pixel area and the backlight module area are in one-to-one correspondence. Each of the pixel areas includes a plurality of pixel units. The driving method includes:

acquiring a first component, a second component, and a third component of each of the pixel units in the pixel area in a first color space;

acquiring a tone angle value and a saturation in a second color space according to an average value of the first component, an average value of the second component, and an average value of the third component of the pixel unit in the pixel area;

acquiring a maximum target gray-scale value of a specified pixel unit in the pixel area according to the tone angle value and the saturation;

matching a display gray-scale value group corresponding to the specified pixel unit to a target gray-scale value group according to the maximum target gray-scale value; the number of gray-scale values in the display gray-scale value group is equal to the number of gray-scale values in the target gray-scale value group, the maximum target gray-scale value is less than a maximum display gray-scale value in the display gray-scale value group; and driving the specified pixel unit in the pixel area to display according to the target gray-scale value group.

Optionally, the step of matching the display gray-scale value group corresponding to the specified pixel unit to the target gray-scale value group includes:

matching a minimum display gray-scale value in the display gray-scale value group to a minimum target gray-scale value;

acquiring target gray-scale values that are in one-to-one correspondence with display gray-scale values in the display gray-scale value group according to the display gray-scale values in the display gray-scale value group, lightness corresponding to the minimum target gray-scale value, lightness corresponding to the maximum target gray-scale value, and a specified gamma value;

match the display gray-scale value in the display gray-scale value group to the corresponding target gray-scale value; the display gray-scale value is greater than the minimum display gray-scale value in the display gray-scale value group and is less than the maximum display gray-scale value in the display gray-scale value group; and match the maximum display gray-scale value in the display gray-scale value group to the maximum target gray-scale value.

Optionally, after the step of matching the display gray-scale value group corresponding to the specified pixel unit to the target gray-scale value group according to the maximum target gray-scale value, the method further includes:

adjusting lightness of a red backlight module according to the maximum display gray-scale value in the display gray-scale value group corresponding to the specified pixel unit and the maximum target gray-scale value in the target gray-scale value group;

a ratio of adjusted lightness of the red backlight module to lightness of the red backlight module before adjusting is equal to a ratio of lightness corresponding to the maximum display gray-scale value in the display gray-scale value group to lightness corresponding to the maximum target gray-scale value in the target gray-scale value group.

Optionally, the minimum display gray-scale value in the display gray-scale value group is equal to the minimum target gray-scale value in the target gray-scale value group.

Optionally, the first color space is a Red Green Blue RGB color space.

Optionally, the second color space is an LCH color space.

Optionally, the minimum target gray-scale value is zero.

Optionally, the maximum display gray-scale value is 225.

The embodiments of the present disclosure further provide a display device, which includes a display panel. The display panel includes at least one pixel area and at least one backlight module area. The pixel area and the backlight module area are in one-to-one correspondence. Each of the pixel areas includes a plurality of pixel units. The display device includes:

a component acquiring module configured to acquire a first component, a second component, and a third component of each of the pixel units in the pixel area in a first color space;

a tone saturation acquiring module coupled to the component acquiring module, the tone saturation acquiring module is configured to acquire a tone angle value and a saturation in a second color space according to an average value of the first component, an average value of the second component, and an average value of the third component of the pixel unit in the pixel area;

a maximum target gray-scale acquiring module coupled to the tone saturation acquiring module, the maximum target gray-scale acquiring module is configured to acquire a maximum target gray-scale value of a specified pixel unit in the pixel area according to the tone angle value and the saturation;

a matching module coupled to the maximum target gray-scale acquiring module, the matching module is configured to match a display gray-scale value group corresponding to the specified pixel unit to a target gray-scale value group according to the maximum target gray-scale value; the number of gray-scale values in the display gray-scale value group is equal to the number of gray-scale values in the target gray-scale value group, the maximum target gray-scale value is less than a maximum display gray-scale value in the display gray-scale value group; and a driving module coupled to the matching module, the driving module is configured to drive the specified pixel unit in the pixel area to display according to the target gray-scale value group.

Optionally, the display device further includes:

a backlight module configured to provide a backlight source to the display panel.

Optionally, the matching module is configured to:

matching a minimum display gray-scale value in the display gray-scale value group to a minimum target gray-scale value;

acquiring target gray-scale values that are in one-to-one correspondence with display gray-scale values in the display gray-scale value group according to the display gray-scale values in the display gray-scale value group, lightness corresponding to the minimum target gray-scale value, lightness corresponding to the maximum target gray-scale value, and a specified gamma value;

match the display gray-scale value in the display gray-scale value group to the corresponding target gray-scale value; the display gray-scale value is greater than the minimum display gray-scale value in the display gray-scale value group and is less than the maximum display gray-scale value in the display gray-scale value group; and match the maximum display gray-scale value in the display gray-scale value group to the maximum target gray-scale value.

Optionally, the display device further includes:

a backlight lightness adjusting module configured to adjust lightness of a red backlight module according to the maximum display gray-scale value in the display gray-scale value group and the maximum target gray-scale value in the target gray-scale value group, after the step of matching the display gray-scale value group corresponding to the specified pixel unit to the target gray-scale value group according to the maximum target gray-scale value; and a control module configured to control a ratio of adjusted lightness of the red backlight module to lightness of the red backlight module before adjusting to be equal to a ratio of lightness corresponding to the maximum display gray-scale value in the display gray-scale value group to lightness corresponding to the maximum target gray-scale value in the target gray-scale value group.

Optionally, the first color space is a Red Green Blue RGB color space.

Optionally, the second color space is an LCH color space.

Optionally, the minimum target gray-scale value is zero.

Optionally, the maximum display gray-scale value is 225.

The embodiments of the present disclosure further provide a driving method of a display device, which includes:

acquiring a first component, a second component, and a third component of each pixel unit in a display panel in a first color space;

acquiring a tone angle value and a saturation in a second color space according to an average value of the first component, an average value of the second component, and an average value of the third component of the pixel unit;

acquiring a maximum target gray-scale value of a specified pixel unit according to the tone angle value and the saturation;

matching a minimum display gray-scale value in the display gray-scale value group to a minimum target gray-scale value;

acquiring target gray-scale values that are in one-to-one correspondence with display gray-scale values in the display gray-scale value group according to the display gray-scale values in the display gray-scale value group, lightness corresponding to the minimum target gray-scale value, lightness corresponding to the maximum target gray-scale value, and a specified gamma value;

matching the display gray-scale value in the display gray-scale value group to the corresponding target gray-scale value; the display gray-scale value is greater than the minimum display gray-scale value in the display gray-scale value group and is less than a maximum display gray-scale value in the display gray-scale value group;

matching the maximum display gray-scale value in the display gray-scale value group to the maximum target gray-scale value; the maximum target gray-scale value is less than the maximum display gray-scale value in the display gray-scale value group; and driving the specified pixel unit in the display panel to display according to the target gray-scale value group.

Optionally, the minimum display gray-scale value in the display gray-scale value group is equal to the minimum target gray-scale value in the target gray-scale value group.

Optionally, the first color space is a Red Green Blue RGB color space, the second color space is an LCH color space.

The embodiments of the present disclosure further provide a computer readable storage medium storing computer executable instructions configured to perform the above method.

The embodiments of the present disclosure further provide a display apparatus. The display apparatus includes one or more processors, a memory, and one or more programs. The one or more programs are stored in the memory, and when executed by the one or more processors, the above method is performed.

The embodiments of the present disclosure further provide a computer program product. The computer program product includes a computer program stored on a non-transitory computer readable storage medium. The computer program includes program instructions, which, when executed by a computer cause the computer to perform any of the methods described above.

The embodiments of the present disclosure provide a driving method of a display device and the display device. By matching the display gray-scale value group corresponding to the specified pixel unit to the target gray-scale value group, the maximum target gray-scale value obtained according to the tone angle value and the saturation is less than the maximum display gray-scale value in the display gray-scale value group, the specified pixel unit in the display panel is driven to display according to the matched target gray-scale value group, and a part of the high gray-scale value in the display gray-scale value group is deleted, which can effectively eliminate the influence of high gray-scale on the color saturation of the specified pixel unit under the large viewing angle, thereby optimizing the display effect of the display device.

DETAILED DESCRIPTION OF THE EMBODIMENTS

In a display device, when a driving voltage of a pixel unit drops to a certain extent, the vividness of the pixel unit can be close to the vividness of the pixel unit at a front viewing angle only in the case of a large viewing angle. In other words, in the case of the large viewing angle, the color of the pixel unit when the driving voltage is high (high gray-scale) is severely shifted with respect to the color of the pixel unit at the front viewing angle, such that the color vividness of the pixel unit at the high gray-scale is lowered in the case of the large viewing angle, and the color shift is severe. In order to solve the problem, embodiments of the present disclosure provide a driving method of a display device, the display device, and a display apparatus.

Figure 1:
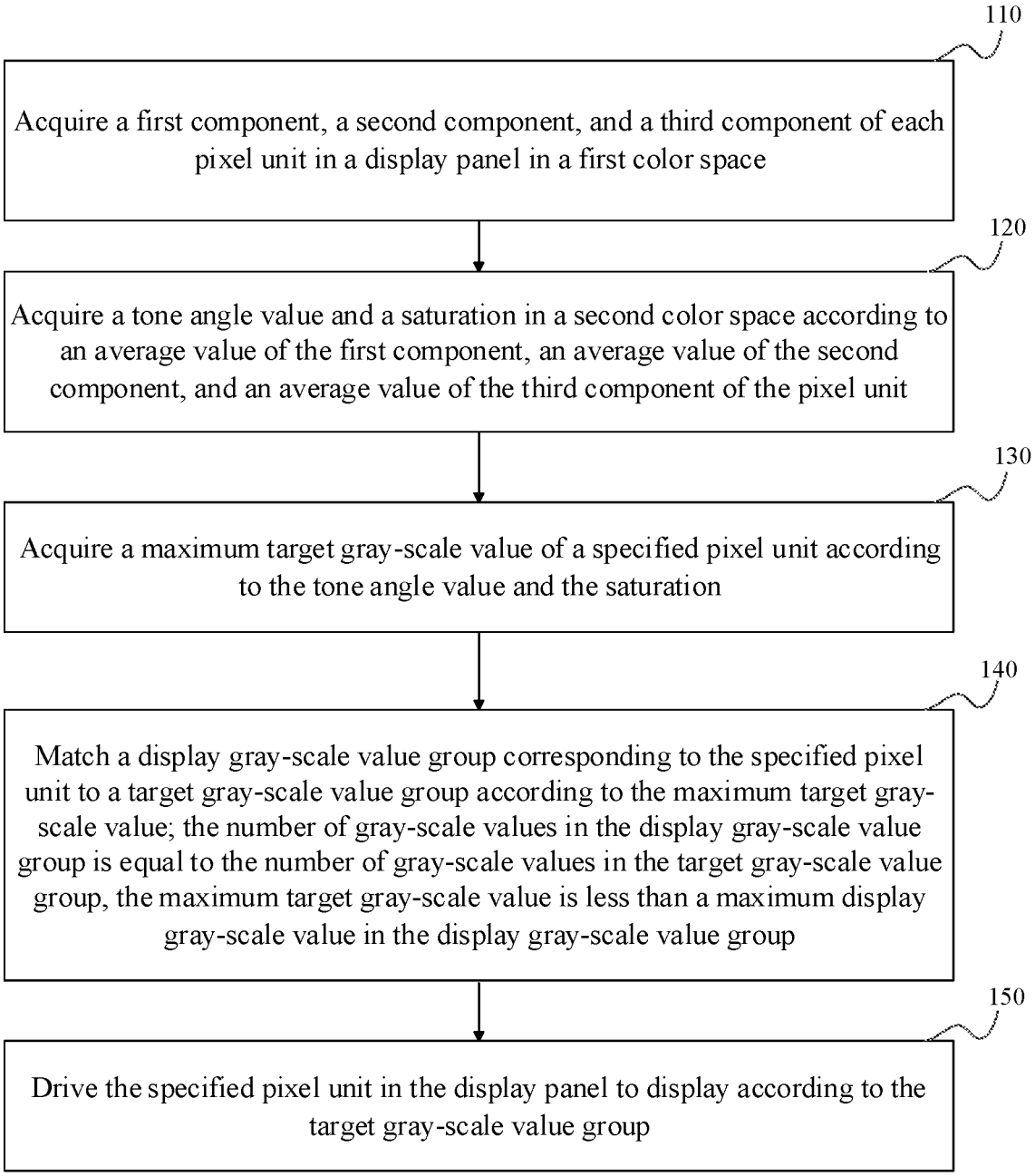
FIG. 1 is a flowchart of a driving method of a display device according to an embodiment.

FIG. 1 is a flowchart of a driving method of a display device according to the embodiments of the present disclosure. The driving method can be applied to a scene in which the display device is required to be driven to perform flat panel display, and can be executed by the display device provided in the present embodiment. The display device includes a display panel, which includes at least one pixel area and at least one backlight module area. The pixel area and the backlight module area are in one-to-one correspondence. Each of the pixel areas includes a plurality of pixel units. When all pixel units in the display panel belong to one area, the method includes:

In step 110, a first component, a second component, and a third component of each of the pixel units in the display panel in a first color space are acquired.

In step 120, a tone angle value and a saturation in a second color space are acquired according to an average value of the first component, an average value of the second component, and an average value of the third component of the pixel unit.

Exemplarily, the first color space may be a RGB color space, then the first component may be a R component, the second component may be a G component, and the third component may be a B component. The RGB color space is defined based on the color recognized by the human eye, in which three values of the tone angle value, lightness, and the saturation are represented together, such that the R component, the G component, and the B component are correlated with each other, that is, the R component, the G component, and the B component are not independent from each other.

Exemplarily, the first component, the second component, and the third component of each of the pixel units in the display panel in the first color space are acquired, thereby acquiring the average value Ave R of the first component, the average value Ave G of the second component, and the average value Ave B of the third component of all pixel units in the display panel. The second color space may be exemplarily configured to an LCH color space. The RGB color space may be converted to the LCH color space (L is lightness, C is saturation, and H is tone angle value), in which the lightness L, the saturation C, and the tone angle value H are independent from each other, and the determination of parameter of the pixel unit in the display panel can be performed according to a single component. The tone angle value H and the saturation C in the second color space can be acquired according to the acquired average value Ave R of the first component, the average value Ave G of the second component, and the average value Ave B of the third component of the pixel unit. For example, H can be equal to f1 (Ave R, Ave G, Ave B), and C can be equal to f2 (Ave R, Ave G, Ave B).

In step 130, a maximum target gray-scale value of a specified pixel unit is acquired according to the tone angle value and the saturation.

The maximum target gray-scale value of the pixel unit can be acquired according to the acquired tone angle value and saturation in the second color space. When referring to the second color space as the LCH color space, and when the tone angle value H according to the pixel unit is 0°, the pixel unit renders a pure red color. When the tone angle value H according to the pixel unit is 90°, the pixel unit renders a pure yellow color. When the tone angle value H according to the pixel unit is 180°, the pixel unit renders a pure green color. When the tone angle value H according to the pixel unit is 270°, the pixel unit renders a pure blue color. As the tone angle value H of the pixel unit changes from 0° to 360°, the color rendered by the pixel unit gradually changes from pure red color to pure yellow color, then to pure green color, then to pure blue color, and then back to pure red color. In addition, the range of the saturation C of the pixel unit in the LCH color space may be greater than or equal to 0 and less than or equal to 100.

Exemplarily, when the acquired tone angle value H is greater than 0° and is less than or equal to 45°, or is greater than 315° and is less than or equal to 360°, it can be determined that the pixel unit in the display panel renders a color close to red color, and then the range in which the acquired saturation C is located is determined. For example, when the acquired saturation C is greater than C1 and less than C2 (C2 is greater than C1), it can be determined that the maximum target gray-scale value of the specified pixel unit is Rx.

Exemplarily, the maximum target gray-scale value Rx can be configured to 220, which can eliminate the influence of the high gray-scale value greater than 220 on the saturation of the specified pixel unit in the display panel, thereby optimizing the display effect of the display device.

The determination of the saturation C can be defined in a specific range according to the user's requirement of the saturation of the specified pixel unit in the display panel, which is not limited in the embodiment of the present disclosure.

In step 140, a display gray-scale value group corresponding to the specified pixel unit is matched to a target gray-scale value group according to the maximum target gray-scale value. The number of gray-scale values in the display gray-scale value group is equal to the number of gray-scale values in the target gray-scale value group. The maximum target gray-scale value is less than a maximum display gray-scale value in the display gray-scale value group.

Optionally, a minimum display gray-scale value in the display gray-scale value group can be matched to a minimum target gray-scale value. With respect to a display gray-scale value in the display gray-scale value group which is greater than the minimum display gray-scale value and is less than the maximum display gray-scale value, target gray-scale values that are in one-to-one correspondence with these display gray-scale values in the display gray-scale value group can be acquired according to these display gray-scale values in the display gray-scale value group, lightness corresponding to the minimum target gray-scale value, lightness corresponding to the maximum target gray-scale value, and a specified gamma value, and these display gray-scale values in the display gray-scale value group are matched to the corresponding target gray-scale values. The maximum display gray-scale value in the display gray-scale value group is matched to the maximum target gray-scale value obtained according to the tone angle value and the saturation. Since the maximum target gray-scale value obtained according to the tone angle value and the saturation in the target gray-scale value group according to the specified pixel unit is less than the maximum display gray-scale value in the display gray-scale value group, the influence of high gray-scale on the color saturation of the specified pixel unit under the large viewing angle can be effectively eliminated, and the display effect of the display device is optimized.

When gray-scale values of the pixel unit are different, the lightness correspondingly rendered by the pixel unit is also different. The greater the gray-scale value corresponding to the pixel unit, the larger the lightness of the pixel unit. With respect to the display gray-scale value in the display gray-scale value group corresponding to the specified pixel unit in the display panel which is greater than the minimum display gray-scale value and is less than the maximum display gray-scale value, the target gray-scale values that are in one-to-one correspondence with the display gray-scale values in the display gray-scale value group are all acquired according to the display gray-scale values in the display gray-scale value group, lightness corresponding to the minimum target gray-scale value, lightness corresponding to the maximum target gray-scale value, and the specified gamma value.

Exemplarily, the specified pixel unit may be, for example, a red pixel unit R. The maximum target gray-scale value obtained according to the tone angle value and the saturation can be configured to Rx, and then the lightness corresponding to the maximum target gray-scale value Rx can be configured to RLRx. The specified gamma value is configured to be equal to a gamma value of an original gamma curve corresponding to the specified pixel unit R as $\gamma$. The minimum target gray-scale value is configured to 0, and then the lightness corresponding to the minimum target gray-scale value can be configured to RL0. Taking the display gray-scale value a in the display gray-scale value group corresponding to the red pixel unit R as an example, a is greater than the minimum display gray-scale value 0 and is less than the maximum display gray-scale value Rx, and then the target gray-scale value a1 corresponding to a can be equal to f (a, RL0, $\gamma$, RLRx). In other words, a1 is a function of the display gray-scale value a in the display gray-scale value group, the lightness RL0 corresponding to the minimum target gray-scale value 0, the lightness RLRx corresponding to the maximum target gray-scale value Rx, and the gamma value $\gamma$ of the original gamma curve corresponding to the red pixel unit R. In other words, a1 is related to the display gray-scale value a in the display gray-scale value group, the lightness RL0 corresponding to the minimum target gray-scale value 0, the lightness RLRx corresponding to the maximum target gray-scale value Rx, and the gamma value $\gamma$ of the original gamma curve corresponding to the red pixel unit R.

TABLE 1

Correspondence relationship between the display gray-scale value group and the target gray-scale value group of the pixel unit

| Display gray-scale value group | | | Target gray-scale value group | | |
|---|---|---|---|---|---|
| R | G | B | R | G | B |
| 0 | 0 | 0 | 0 | 0 | 0 |
| 1 | 1 | 1 | f ( 1, RLO, $\gamma$, RLRx ) | 1 | 1 |
| 2 | 2 | 2 | f ( 2, RLO, $\gamma$, RLRx ) | 2 | 2 |
| 3 | 3 | 3 | f ( 3, RLO, $\gamma$, RLRx ) | 3 | 3 |
| 4 | 4 | 4 | f ( 4, RLO, $\gamma$, RLRx ) | 4 | 4 |
| 5 | 5 | 5 | f ( 5, RLO, $\gamma$, RLRx ) | 5 | 5 |
| . . . | . . . | . . . | . . . | . . . | . . . |
| 250 | 250 | 250 | f ( 250, RL0, $\gamma$, RLRx ) | 250 | 250 |
| 251 | 251 | 251 | f ( 251, RL0, $\gamma$, RLRx ) | 251 | 251 |
| 252 | 252 | 252 | f ( 252, RL0, $\gamma$, RLRx ) | 252 | 252 |
| 253 | 253 | 253 | f ( 253, RL0, $\gamma$, RLRx ) | 253 | 253 |
| 254 | 254 | 254 | f ( 254, RL0, $\gamma$, RLRx ) | 254 | 254 |
| 255 | 255 | 255 | Rx | 255 | 255 |

Exemplarily, Table 1 shows a correspondence relationship between the display gray-scale value group and the target gray-scale value group of the pixel unit in a display panel according to the present embodiment. Taking the specified pixel unit as the red pixel unit R as an example, it is possible to configured the display gray-scale value group and the target gray-scale value group corresponding to the red pixel unit R in the display panel to have 8 bits. It can be seen from Table 1 that the number of gray-scale values in the display gray-scale value group and the target gray-scale value group corresponding to the red pixel unit R of the display panel are equal. In order to avoid the problem of severe color shift of the red pixel unit R in the display panel under the large viewing angle caused by the high gray-scale value, the display gray-scale value group corresponding to the red pixel unit R in Table 1 is matched to the target gray-scale value group corresponding to the red pixel unit R. With respect to a display gray-scale value in the display gray-scale value group which is greater than the minimum display gray-scale value and is less than the maximum display gray-scale value, the target gray-scale value in the target gray-scale value group corresponding to the red pixel unit R can be obtained according to the display gray-scale value in the display gray-scale value group, the lightness corresponding to the minimum target gray-scale value, the lightness corresponding to the maximum target gray-scale value, and the specified gamma value.

Exemplarily, referring to Table 1, the blue pixel unit B can still be displayed by using the display gray-scale value group corresponding to the blue pixel unit B. Similarly, the green pixel unit G can also be displayed by using the display gray-scale value group corresponding to the green pixel unit G In this embodiment, the number of bits of the display gray-scale value group and the target gray-scale value group corresponding to the pixel unit is also not limited.

Optionally, the minimum target gray-scale value in the target gray-scale value group can be configured to be equal to the minimum display gray-scale value in the display gray-scale value group. Taking the specified pixel unit as the red pixel unit R as an example, since the maximum target gray-scale value Rx in the target gray-scale value group corresponding to the red pixel unit R in the display panel is less than the maximum display gray-scale value in the display gray-scale value group corresponding to the red pixel unit R, in order to improve the display resolution of the display panel, the minimum target gray-scale value in the target gray-scale value group corresponding to the red pixel unit R may be configured equal to the minimum display gray-scale value 0 in the display gray-scale value group, such that a span between the minimum target gray-scale value and the maximum target gray-scale value in the target gray-scale value group corresponding to the red pixel unit R is large, the display resolution of the display panel is improved while eliminating the influence of the high gray-scale on the color saturation of the red pixel unit R in the case of the large viewing angle.

In step 150, the specified pixel unit in the display panel is driven to display according to the target gray-scale value group.

Exemplarily, the specified pixel unit can be the red pixel unit R, and the red pixel unit R in the display panel is driven to display according to the target gray-scale value group corresponding to the red pixel unit R in the display panel obtained in the above steps. Since the maximum target gray-scale value Rx obtained according to the tone angle value and the saturation in the target gray-scale value group corresponding to the red pixel unit R is less than the maximum display gray-scale value 225 in the display gray-scale value group corresponding to the red pixel unit R, the part of the high gray-scale value in the display gray-scale value group is deleted, which effectively avoids the color shift problem of the red pixel unit R caused by the high gray-scale affecting the color saturation of the red pixel unit R in the case of the large viewing angle, and improves the display effect of the display device.

Figure 2:
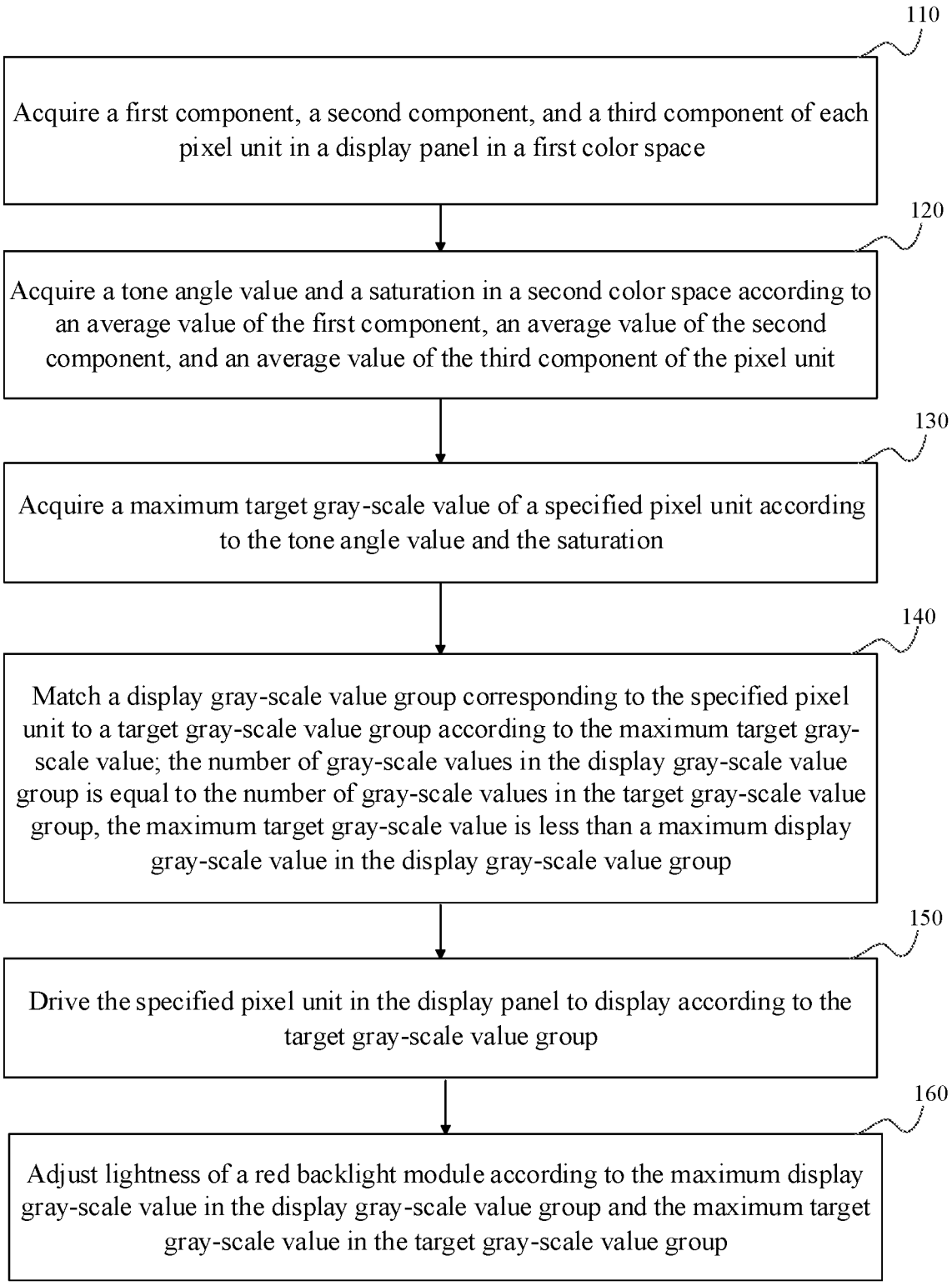
FIG. 2 is a flowchart of another driving method of a display device according to an embodiment.

Optionally, FIG. 2 is a flowchart of another driving method of a display device according to the present embodiment. Different from the aforementioned embodiment, the driving method further includes the following steps of:

In step 160, lightness of a red backlight module is adjusted according to the maximum display gray-scale value in the display gray-scale value group and the maximum target gray-scale value in the target gray-scale value group. A ratio of adjusted lightness of the red backlight module to lightness of the red backlight module before adjusting is equal to a ratio of lightness corresponding to the maximum display gray-scale value in the display gray-scale value group to lightness corresponding to the maximum target gray-scale value in the target gray-scale value group.

Taking the specified pixel unit as the red pixel unit R as an example, since the maximum target gray-scale value in the target gray-scale value group corresponding to the red pixel unit R in the display panel is less than the maximum display gray-scale value in the display gray-scale value group, taking the display gray-scale value group, the display gray-scale value group corresponding to the red pixel unit R in the display panel, and the target gray-scale value group corresponding to the red pixel unit R in the display panel having 8 bits, and the maximum target gray-scale value as Rx as an example (Rx less than 255), that is, the maximum lightness of the red pixel unit R in the display panel is reduced from the lightness RL255 corresponding to the original 255 gray-scale to the lightness RLRx corresponding to the Rx gray-scale. Therefore, it is required to supplement the backlight lightness enhancement corresponding to the red pixel unit R to maintain the original white point in the display panel formed by a mixture of the 255 gray-scale red pixel unit R, the 255 gray-scale blue pixel unit B, and the 255 gray-scale green pixel unit G Exemplarily, the lightness of the red backlight module before adjusting can be configured to A, and the adjusted lightness of the red backlight module is A', and then A and A' is required to satisfy the following formula:

$$\frac{A'}{A} = \frac{RL255}{RLRx}$$

In other words, the ratio of the adjusted lightness A' of the red backlight module to the lightness A of the red backlight module before adjusting is equal to the ratio of the lightness RL225 corresponding to the maximum display gray-scale value 225 in the display gray-scale value group to the lightness RLRx corresponding to the maximum target gray-scale value Rx in the target gray-scale value group.

Figure 3:
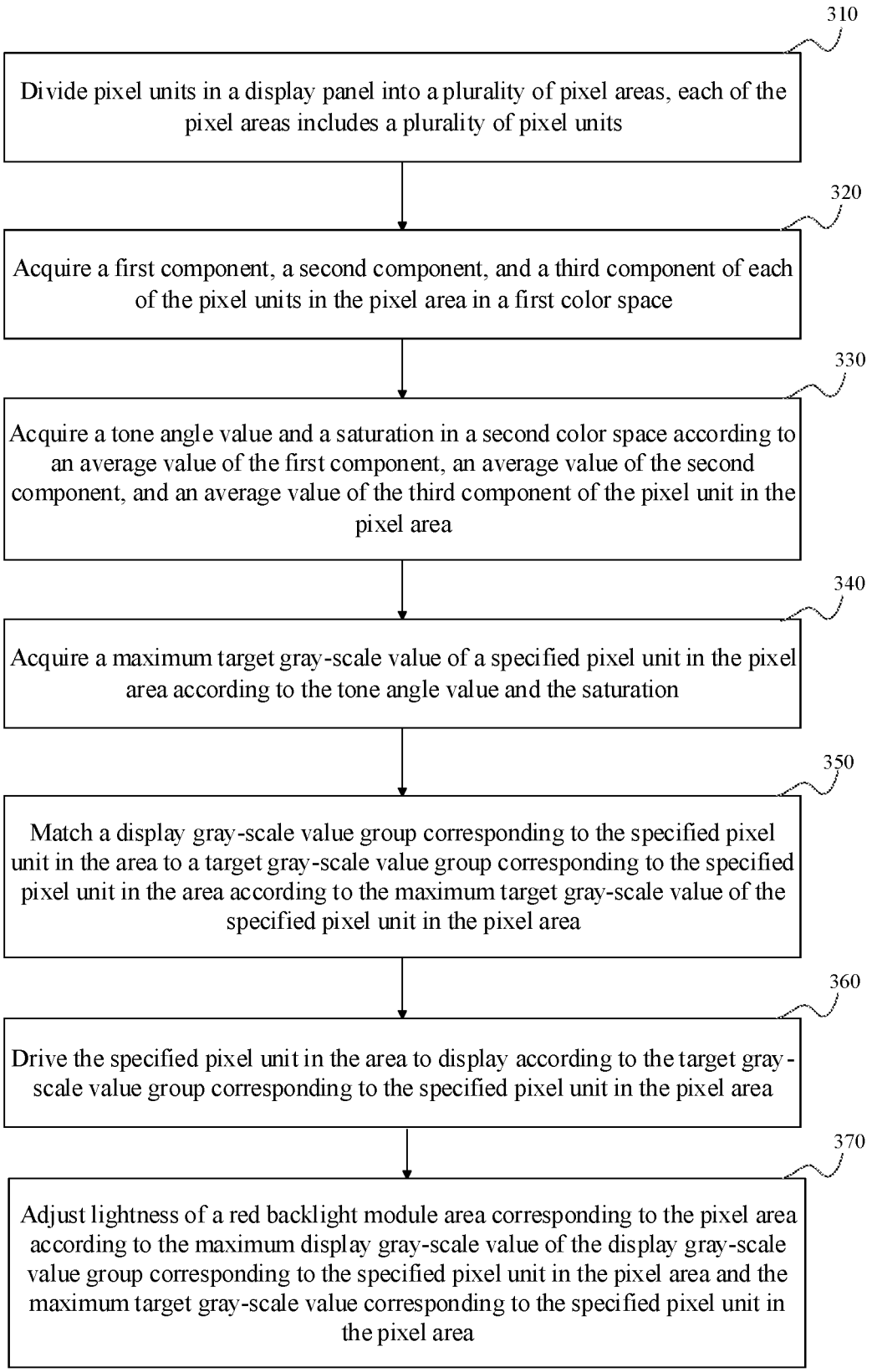
FIG. 3 is a flowchart of another driving method of a display device according to an embodiment.

Optionally, FIG. 3 is a flowchart of another driving method of a display device according to the embodiment. The method can also be executed by the display device provided in the present embodiment. The method includes:

In step 310, pixel units in a display panel are divided into a plurality of pixel areas, and each of the pixel areas includes a plurality of pixel units.

The display panel can include a plurality of pixel units arranged in a matrix, that is, a plurality of rows and columns of pixel units. The pixel unit in the display panel can be divided into a plurality of pixel areas. Each of the pixel areas can include a plurality of rows and columns of pixel units therein, that is, each of the pixel areas includes a plurality of pixel units.

In step 320, a first component, a second component, and a third component of each of the pixel units in the pixel area in a first color space are acquired.

The first component, the second component, and the third component of each of the pixel units in each of the divided pixel areas in the first color space are acquired, such that an average value Ave R' of the first component, an average value Ave G' of the second component, and an average value Ave B' of the third component of all pixel units in the pixel area can be acquired.

In step 330, a tone angle value and a saturation in a second color space are acquired according to the average value of the first component, the average value of the second component, and the average value of the third component of the pixel unit in the pixel area.

The tone angle value H' and the saturation C' in the second color space can be acquired according to the average value Ave R' of the first component, the average value Ave G' of the second component, and the average value Ave B' of the third component of the pixel unit in the pixel area. Exemplarily, H' can be equal to f1 (Ave R', Ave G', Ave B'), and C' can be equal to f2 (Ave R', Ave G', Ave B').

In step 340, a maximum target gray-scale value of a specified pixel unit in the pixel area is acquired according to the tone angle value and the saturation.

Exemplarily, taking the specified pixel unit as the red pixel unit R as an example, when the acquired tone angle value is greater than 0° and is less than or equal to 45°, or is greater than 315° and is less than or equal to 360°, it can be determined that the pixel unit in the pixel area of the display panel renders a color close to red color, and then the range in which the acquired saturation is located is determined. For example, when the acquired saturation is greater than C1 and less than C2, it can be determined that the maximum target gray-scale value of the red pixel unit R in the pixel area is Rx.

In step 350, a display gray-scale value group corresponding to the specified pixel unit in the pixel area is matched to a target gray-scale value group corresponding to the specified pixel unit in the pixel area according to the maximum target gray-scale value of the specified pixel unit in the pixel area.

Exemplarily, a minimum display gray-scale value in the display gray-scale value group corresponding to the specified pixel unit in the pixel area may be similarly matched to a minimum target gray-scale value in the target gray-scale value group. A maximum display gray-scale value in the display gray-scale value group corresponding to the specified pixel unit in the pixel area is matched to the maximum target gray-scale value in the target gray-scale value group obtained according to the tone angle value and the saturation. The target gray-scale values that are in one-to-one correspondence with these display gray-scale values in the display gray-scale value group is acquired according to the display gray-scale values in the display gray-scale value group which is greater than the minimum display gray-scale value and less than the maximum display gray-scale value, lightness corresponding to the minimum target gray-scale value, lightness corresponding to the maximum target gray-scale value, and a specified gamma value, and these display gray-scale values in the display gray-scale value group are matched to the target gray-scale values.

In step 360, the specified pixel unit in the pixel area is driven to display according to the target gray-scale value group corresponding to the specified pixel unit in the pixel area.

Exemplarily, taking the specified pixel unit as the red pixel unit R as an example, and the red pixel unit R in the pixel area of the display panel is driven to display according to the target gray-scale value group corresponding to the red pixel unit R in the display panel obtained in the above steps. Since the maximum target gray-scale value obtained according to the tone angle value and the saturation in the target gray-scale value group corresponding to the red pixel unit R in the pixel area is less than the maximum display gray-scale value in the display gray-scale value group corresponding to the red pixel unit R, which effectively avoids the color shift problem of the red pixel unit R caused by the high gray-scale affecting the color saturation of the red pixel unit R in the pixel area in the case of the large viewing angle, and improves the display effect of the display device.

In step 370, lightness of a red backlight module area corresponding to the pixel area is adjusted according to the maximum display gray-scale value in the display gray-scale value group corresponding to the specified pixel unit in the pixel area and the maximum target gray-scale value in the target gray-scale value group in the pixel area.

Figure 4:
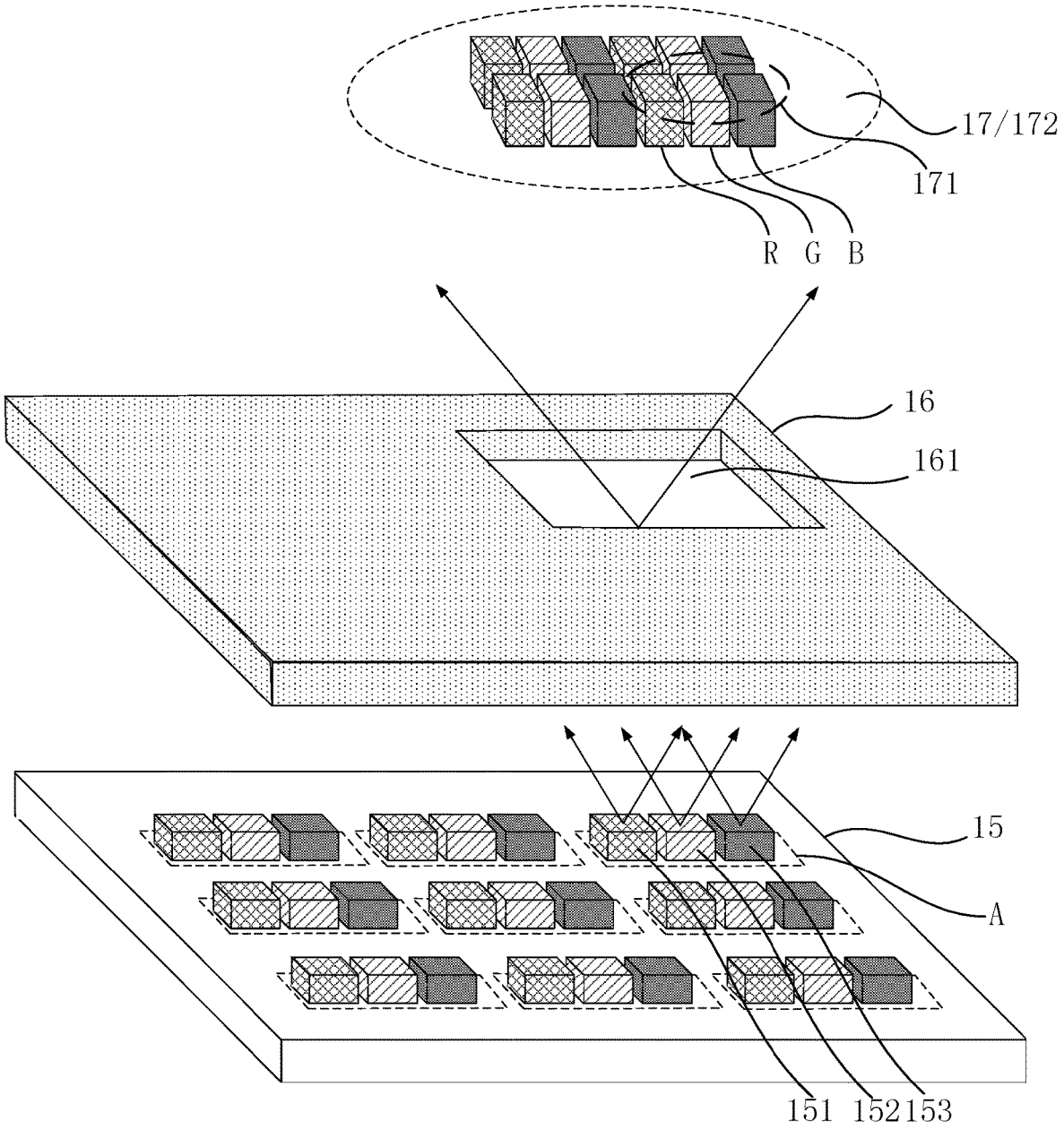
FIG. 4 is a schematic view of a display device according to an embodiment.

Exemplarily, FIG. 4 is a schematic view of a display device according to the present embodiment. The display device can be, for example, a liquid crystal display device. Referring to FIG. 4, the display device can include a display panel and a backlight module 15 located under the display panel. The backlight module 15 is used to provide light source for display to the display panel. The display panel can include an array substrate 16 adjacent to the backlight module, and a color film substrate 17 located at a side of the array substrate 16 away from the backlight module 15 (only a partial area is shown). The backlight module 15 can include a plurality of red backlight modules 151, a plurality of green backlight modules 152, and a plurality of blue backlight modules 153. The color film substrate 17 may correspondingly include a plurality of pixel units 171 (four pixel units 171 are exemplarily shown in FIG. 4), and each of the pixel units 171 includes a red pixel unit R, a green pixel unit G, and a blue pixel unit B. The light emitted by the backlight module 15 can be irradiated onto a liquid crystal layer (not shown) between the array substrate 16 and the color film substrate 17 through an opening area 161 on the array substrate 16, thereby achieving a normal function of the liquid crystal display panel.

Exemplarily, referring to FIG. 4, a set of backlight module areas A consisting of the red backlight module 151, the green backlight module 152, and the blue backlight module 153 can be provided corresponding to an area 172 formed by a pixel unit. The lightness of the red backlight module 151 corresponding to the area 172 can be adjusted according to the maximum display gray-scale value in the display gray-scale value group corresponding to the red pixel unit R in the area 172 and the maximum target gray-scale value corresponding to the red pixel unit R in the area 172.

By dividing the pixel unit in the display panel into a plurality of pixel areas and adjusting the lightness of the red backlight module of a certain pixel area formed by the corresponding pixel unit, an accurate adjustment of the lightness of the backlight module in the display device can be achieved, and the original white point in the display panel can be maintained by a mixture of the 255 gray-scale red pixel unit R, the 255 gray-scale blue pixel unit B, and the 255 gray-scale green pixel unit G.

The drawings of the present embodiment are merely illustrative of the size of each element and do not represent the actual size of each element in the display panel.

Figure 5A:
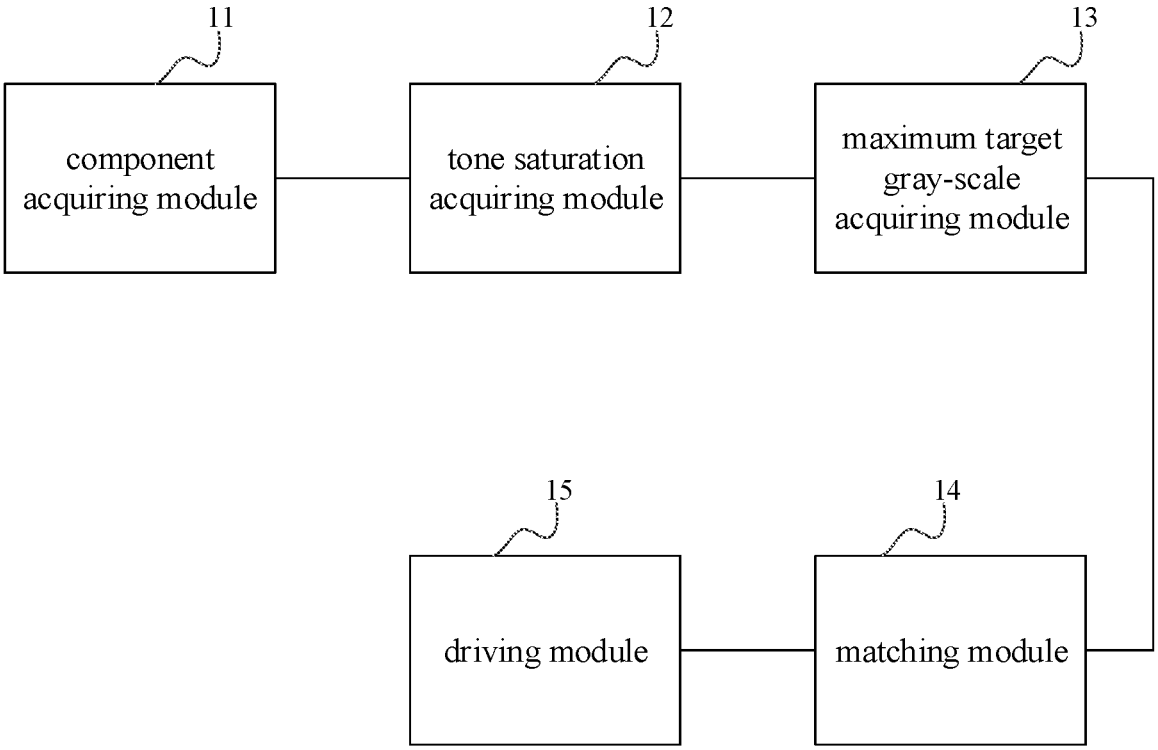
FIG. 5A is a schematic view of another display device according to an embodiment.

FIG. 5A is a schematic view of a display device according to the present embodiment. The display device includes a display panel, which includes at least one pixel area and at least one backlight module area. The pixel area and the backlight module area are in one-to-one correspondence. Each of the pixel areas includes a plurality of pixel units. Referring to FIG. 5A, the display device includes a component acquiring module 11, a tone saturation acquiring module 12, a maximum target gray-scale acquiring module 13, a matching module 14, and a driving module 15. The tone saturation acquiring module 12 is electrically coupled to the component acquiring module 11 and the maximum target gray-scale acquiring module 13, respectively. The matching module 14 is electrically coupled to the maximum target gray-scale acquiring module 13 and a driving module 15, respectively. The driving module 15 is also electrically coupled to the display panel. The backlight module is disposed under the display panel and is used to provide a light source for the display panel. The component acquiring module 11 is configured to acquire a first component, a second component, and a third component of each of the pixel units in a pixel area in a first color space. The tone saturation acquiring module 12 is configured to acquire a tone angle value and a saturation in a second color space according to an average value of the first component, an average value of the second component, and an average value of the third component of the pixel unit in the pixel area. The maximum target gray-scale acquiring module 13 is configured to acquire a maximum target gray-scale value of a specified pixel unit in the pixel area according to the tone angle value and the saturation. The matching module 14 is configured to match a display gray-scale value group corresponding to the specified pixel unit to a target gray-scale value group according to the maximum target gray-scale value. The number of gray-scale values in the display gray-scale value group is equal to the number of gray-scale values in the target gray-scale value group. The maximum target gray-scale value is less than a maximum display gray-scale value in the display gray-scale value group. The driving module 15 is configured to drive the specified pixel unit in the pixel area to display according to the target gray-scale value group. Exemplarily, the display device can be a liquid crystal display device. The display panel includes an array substrate, a color film substrate, and liquid crystal molecules located between the array substrate and the color film substrate. The liquid crystal molecules are deflected by the voltage between the array substrate and the color film substrate to achieve the display function of the liquid crystal display device.

Figure 5B:
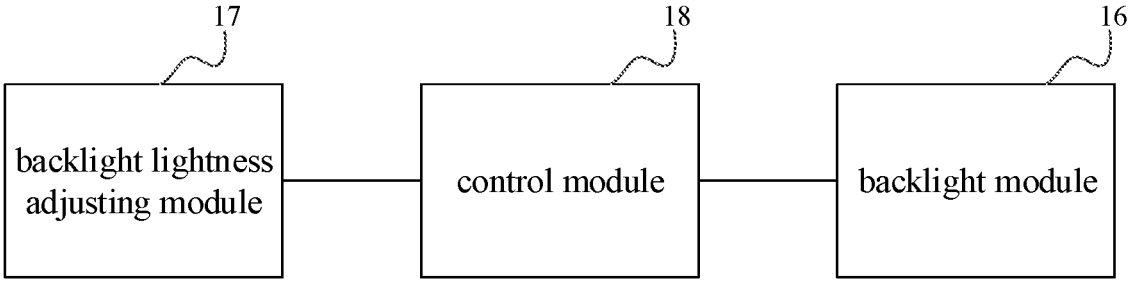
FIG. 5B is a schematic view of another display device according to an embodiment.

Optionally, referring to FIG. 5B, the aforementioned display device further includes a backlight module 16 configured to provide a backlight source to the aforementioned display panel.

Optionally, referring to FIG. 5B, the display device can further include a backlight lightness adjusting module 17 and a control module 18. The backlight lightness adjusting module is configured to adjust lightness of a red backlight module according to the maximum display gray-scale value in the display gray-scale value group and the maximum target gray-scale value in the target gray-scale value group, after the step of matching the display gray-scale value group corresponding to the specified pixel unit to the target gray-scale value group according to the maximum target gray-scale value. The control module is configured to control a ratio of adjusted lightness of the red backlight module to lightness of the red backlight module before adjusting to be equal to a ratio of lightness corresponding to a minimum display gray-scale value in the display gray-scale value group to lightness corresponding to a minimum target gray-scale value in the target gray-scale value group.

Figure 6:
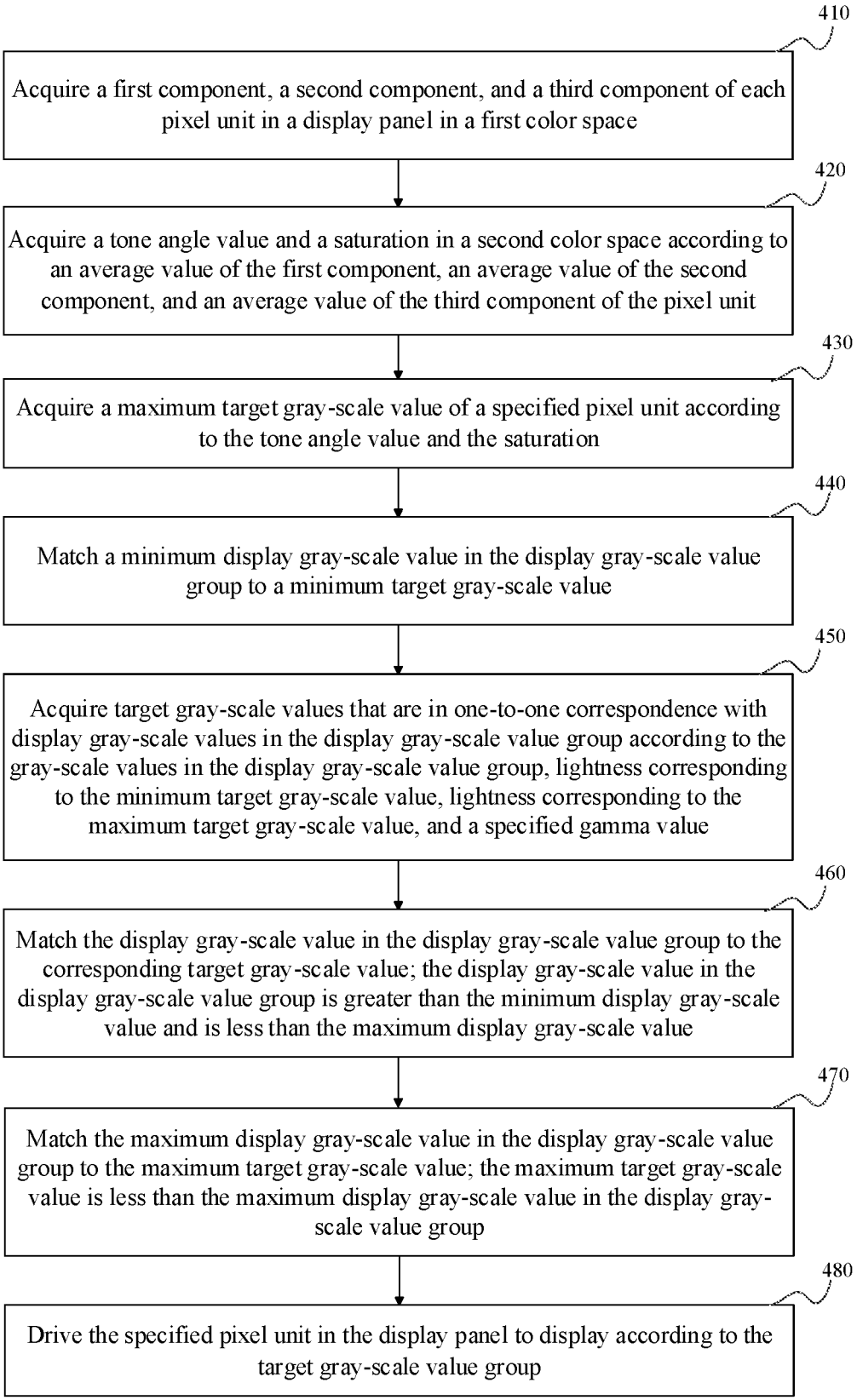
FIG. 6 is a flowchart of another driving method of a display device according to an embodiment.

FIG. 6 is a flowchart of another driving method of a display device according to the present embodiment. The driving method can be applied to a scene in which the display device is required to be driven to perform flat panel display, and can be executed by the display device provided in the present embodiment. The method includes:

In step 410, a first component, a second component, and a third component of each of the pixel units in the display panel in a first color space are acquired.

In step 420, a tone angle value and a saturation in a second color space are acquired according to an average value of the first component, an average value of the second component, and an average value of the third component of the pixel unit.

In step 430, a maximum target gray-scale value of a specified pixel unit is acquired according to the tone angle value and the saturation.

In step 440, a minimum display gray-scale value in the display gray-scale value group is matched to a minimum target gray-scale value.

In step 450, target gray-scale values that are in one-to-one correspondence with display gray-scale values in the display gray-scale value group are acquired according to the gray-scale values in the display gray-scale value group, lightness corresponding to the minimum target gray-scale value, lightness corresponding to the maximum target gray-scale value, and a specified gamma value.

In step 460, the display gray-scale value in the display gray-scale value group is matched to the corresponding target gray-scale value. The display gray-scale value in the display gray-scale value group is greater than the minimum display gray-scale value and is less than the maximum display gray-scale value.

In step 470, the maximum display gray-scale value in the display gray-scale value group is matched to the maximum target gray-scale value. The maximum target gray-scale value is less than the maximum display gray-scale value in the display gray-scale value group.

In step 480, the specified pixel unit in the display panel is driven to display according to the target gray-scale value group.

In the present embodiment, by matching the display gray-scale value group corresponding to the specified pixel unit to a specified gray-scale value group, the maximum target gray-scale value obtained according to the tone angle value and the saturation is less than the maximum display gray-scale value in the display gray-scale value group, the specified pixel unit in the display panel is driven to display according to the matched target gray-scale value group, and the part of the high gray-scale value in the display gray-scale value group is deleted, which can effectively eliminate the influence of high gray-scale on the color saturation of the specified pixel unit under the large viewing angle, thereby optimizing the display effect of the display device.

The present embodiment further provides a computer readable storage medium storing computer executable instructions configured to perform any of the above methods.

Figure 7:
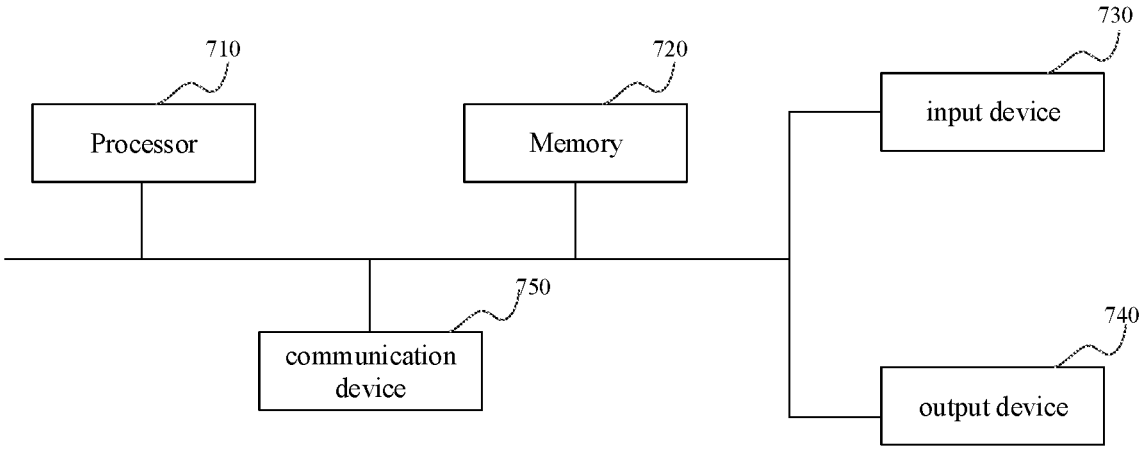
FIG. 7 is a schematic block diagram of a display apparatus according to an embodiment.

FIG. 7 is a schematic block diagram of a display apparatus according to the present embodiment. Referring to FIG. 7, the display apparatus includes one or more processors 710 and a memory 720. One processor 710 is taken as an example in FIG. 7.

The display apparatus can also include an input device 730 and an output device 740.

The processor 710, the memory 720, the input device 730, and the output device 740 in the display apparatus may be connected by a bus or other means, and a bus connection is taken as an example in FIG. 7.

The input device 730 can receive input numeric or character information, and the output device 740 can include display apparatus such as a display screen.

The memory 720 is a computer readable storage medium that can be used to store software programs, computer executable programs, and modules. The processor 710 executes various functional applications and data processing by executing software programs, instructions, and modules stored in the memory 720 to achieve any of the methods in the above embodiments.

The memory 720 can include a storage program area and a storage data area. The storage program area can store an operating system, an application required for at least one function. The storage data area can store data created according to the usage of the display apparatus, and the like. In addition, the memory may include transitory memory such as random access memory (RAM), and may also include non-transitory memory such as at least one magnetic disk storage device, flash memory device, or other non-transitory solid state storage device.

The memory 720 can be a non-transitory computer storage medium or a transitory computer storage medium. The non-transitory computer storage medium can be, for example at least one of magnetic disk storage device, flash memory device, or other non-transitory solid state storage device. In one embodiment, the memory 720 optionally includes a memory remotely located relative to the processor 710, which can be connected to the display apparatus via a network. Examples of the above networks may include the Internet, an intranet, a local area network, a mobile communication network, and combinations thereof.

The input device 730 can be used to receive input numeric or character information and to generate key signal inputs related to user settings and function control of the display apparatus. The output device 740 can include a display apparatus such as a display screen.

The display apparatus of the present embodiment may further include a communication device 750 that transmits and/or receives information over a communication network.

Embodiments of the disclosure may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media, and others.

What is claimed is:

1. A driving method of a display device that includes a pixel area and a backlight module area, wherein the pixel area and the backlight module area are in one-to-one correspondence, and wherein the pixel area includes pixel units, the method comprising:

acquiring first, second, and third components of each of the pixel units in the pixel area in a first color space;

acquiring a first average value of the first components of the pixel units, a second average value of the second components of the pixel units, and a third average value of the third components of the pixel units in the pixel area;

acquiring a tone angle value and a saturation in a second color space according to the first, second, and third average values;

acquiring a maximum target gray-scale value of a specified pixel unit in the pixel area according to the tone angle value and the saturation, wherein the specified pixel unit has a tone angle value greater than 0° and less than or equal to 45°, or greater than 315° and less than or equal to 360°;

matching a display gray-scale value group corresponding to the specified pixel unit to a target gray-scale value group according to the maximum target gray-scale value, wherein a number of gray-scale values in the display gray-scale value group is equal to a number of gray-scale values in the target gray-scale value group, wherein the maximum target gray-scale value is less than a maximum display gray-scale value in the display gray-scale value group, and wherein the step of matching a display gray-scale value group corresponding to the specified pixel unit to a target gray-scale value group includes:

matching a minimum display gray-scale value in the display gray-scale value group to a minimum target gray-scale value;

acquiring target gray-scale values that are in one-to-one correspondence with display gray-scale values in the display gray-scale value group according to the display gray-scale values in the display gray-scale value group, lightness corresponding to the minimum target gray-scale value, lightness corresponding to the maximum target gray-scale value, and a specified gamma value;

matching the display gray-scale value in the display gray-scale value group to the corresponding target gray-scale value, wherein the display gray-scale value is greater than the minimum display gray-scale value in the display gray-scale value group and is less than the maximum display gray-scale value in the display gray-scale value group; and matching the maximum display gray-scale value in the display gray-scale value group to the maximum target gray-scale value; and driving the specified pixel unit in the pixel area to display according to the target gray-scale value group.

2. The driving method of claim 1, wherein after the step of matching a display gray-scale value group corresponding to the specified pixel unit to a target gray-scale value group according to the maximum target gray-scale value, the method further comprises:

adjusting lightness of a red backlight module according to the maximum display gray-scale value in the display gray-scale value group corresponding to the specified pixel unit and the maximum target gray-scale value in the target gray-scale value group, wherein a ratio of adjusted lightness of the red backlight module to lightness of the red backlight module before adjusting is equal to a ratio of lightness corresponding to the maximum display gray-scale value in the display gray-scale value group to lightness corresponding to the maximum target gray-scale value in the target gray-scale value group.

3. The driving method of claim 1, wherein the minimum display gray-scale value in the display gray-scale value group is equal to the minimum target gray-scale value in the target gray-scale value group.

4. The driving method of claim 1, wherein the first color space is a Red Green Blue (RGB) color space.

5. The driving method of claim 1, wherein the second color space is a LCH color space.

6. The driving method of claim 1, wherein the minimum target gray-scale value is zero.

7. The driving method of claim 1, wherein the maximum display gray-scale value is 225.

8. A non-transitory computer readable storage medium storing computer executable instructions configured to perform a method of claim 1.

9. A driving method of a display device, comprising:

acquiring first, second, and third components of each pixel unit in a display panel in a first color space;

acquiring a first average value of the first components of the pixel units, a second average value of the second components of the pixel units, and a third average value of the third components of the pixel units in the pixel area;

acquiring a tone angle value and a saturation in a second color space according to the first, second, and third average values;

acquiring a maximum target gray-scale value of a specified pixel unit according to the tone angle value and the saturation, wherein the specified pixel unit has a tone angle value greater than 0° and less than or equal to 45°, or greater than 315° and less than or equal to 360°;

matching a minimum display gray-scale value in the display gray-scale value group to a minimum target gray-scale value;

acquiring target gray-scale values that are in one-to-one correspondence with display gray-scale values in the display gray-scale value group, lightness corresponding to the minimum target gray-scale value, lightness corresponding to the maximum target gray-scale value, and a specified gamma value;

matching the display gray-scale value in the display gray-scale value group to the corresponding target gray-scale value, wherein the display gray-scale value is greater than the minimum display gray-scale value in the display gray-scale value group and is less than a maximum display gray-scale value in the display gray-scale value group;

matching the maximum display gray-scale value in the display gray-scale value group to the maximum target gray-scale value, wherein the maximum target gray-scale value is less than the maximum display gray-scale value in the display gray-scale value group; and driving the specified pixel unit in the display panel to display according to the target gray-scale value group.

10. The driving method of claim 9, wherein the minimum display gray-scale value in the display gray-scale value group is equal to the minimum target gray-scale value in the target gray-scale value group.

11. The driving method of claim 9, wherein the first color space is a Red Green Blue (RGB) color space, the second color space is a LCH color space.

* * * * *